United States Patent [19]

Spargo et al.

[11] Patent Number: 4,665,892

[45] Date of Patent: May 19, 1987

[54] OVEN DOOR HINGE ASSEMBLY

[75] Inventors: Thomas W. Spargo, Terryville; William J. Arute, Plainville, both of Conn.

[73] Assignee: The Stanley Works, New Britain, Conn.

[21] Appl. No.: 747,715

[22] Filed: Jun. 24, 1985

[51] Int. Cl.[4] ..... F23M 7/00

[52] U.S. Cl. ..... 126/194; 16/284; 16/289; 49/386

[58] Field of Search ..... 126/191, 194; 16/284, 16/286, 289; 49/386

[56] References Cited

U.S. PATENT DOCUMENTS

| | | | |
|---|---|---|---|
| 1,989,151 | 1/1935 | Pickup | 126/191 |
| 2,425,365 | 8/1947 | Davidson | 49/386 X |
| 3,127,889 | 4/1964 | Mills | 126/194 |
| 3,450,125 | 6/1969 | Hopkins . | |
| 3,495,582 | 2/1970 | Maier | 126/194 X |
| 3,503,380 | 3/1970 | Vasaturo . | |
| 3,712,287 | 1/1973 | Summers, Jr. . | |
| 3,749,080 | 7/1973 | Kleinhenn . | |
| 4,021,968 | 5/1977 | Kendall | 49/386 |
| 4,163,344 | 8/1979 | Scherer | 49/386 |
| 4,223,483 | 9/1980 | Stafford | 49/386 |
| 4,269,165 | 5/1981 | Wrotay et al. . | |

FOREIGN PATENT DOCUMENTS

| | | | |
|---|---|---|---|
| 686472 | 7/1930 | France . | |
| 1132648 | 3/1957 | France | 49/386 |
| 975747 | 11/1964 | United Kingdom | 126/191 |

*Primary Examiner*—Randall L. Green

[57] ABSTRACT

A fully assembled hinge mechanism for a door of a major appliance which comprises an elongated guide member arranged to be attached to the appliance at spaced apart front edges thereof having a pivotal door hanger lever extending therefrom, and a hinge arm pivotally connected to the door hanger lever and movable on the guide member to permit opening of a door on the hanger lever where the hinge arm is spring biased into contact with the guide member and the spring counterbalances the weight of the door.

5 Claims, 8 Drawing Figures

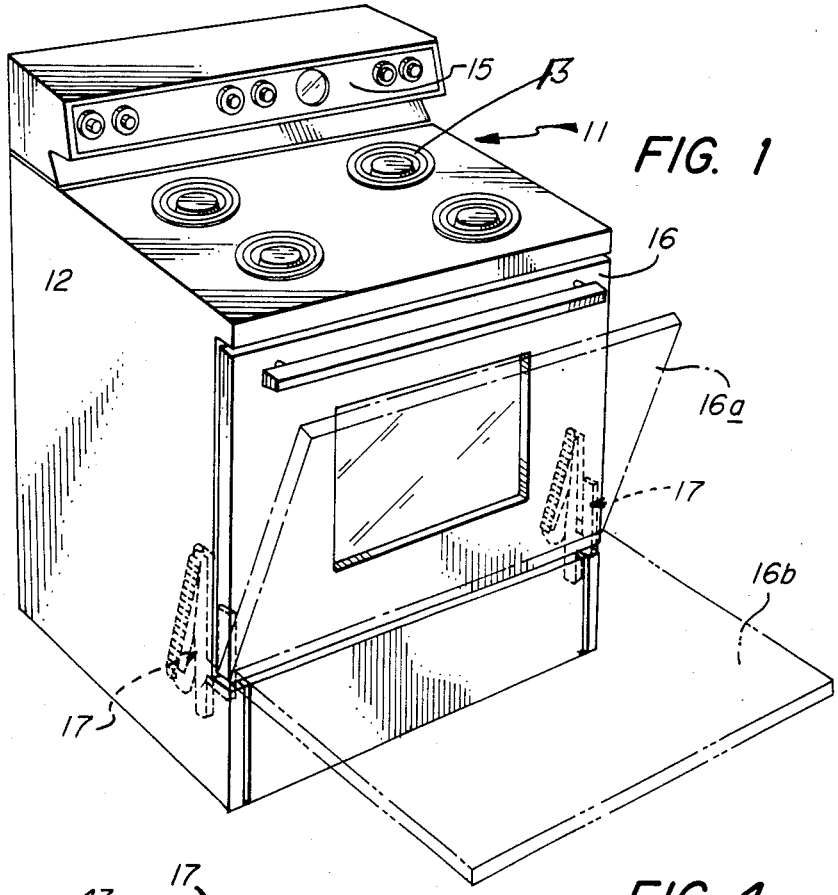
FIG. 1
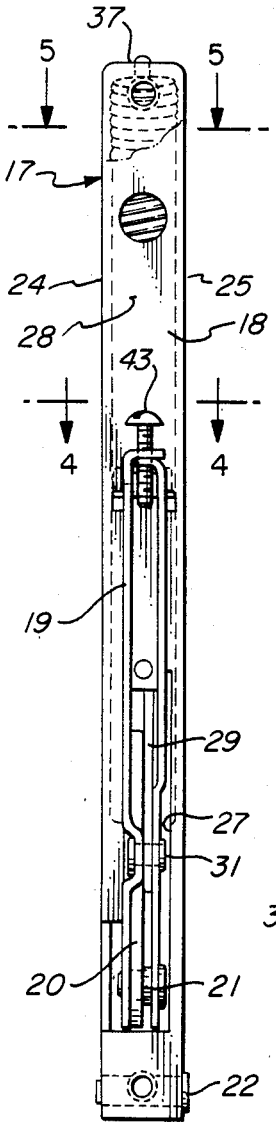
FIG. 2
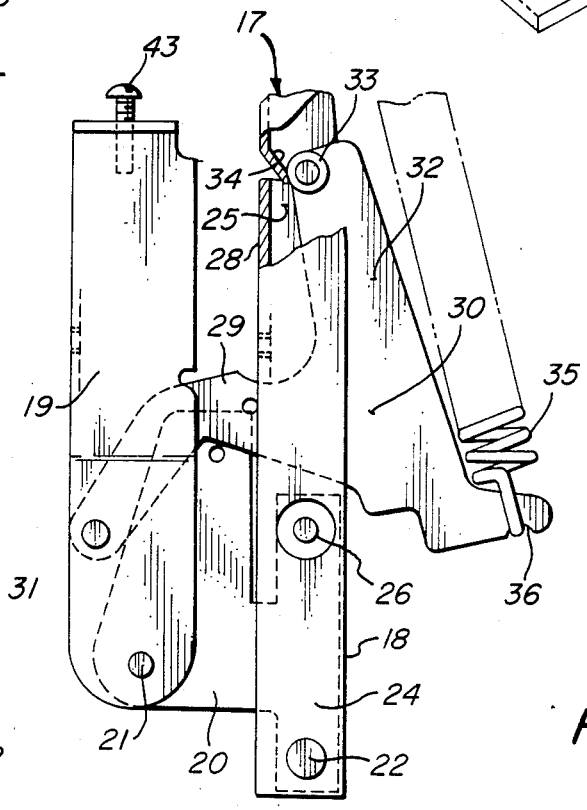
FIG. 3
FIG. 4
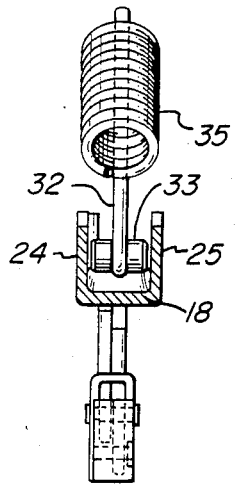
FIG. 5
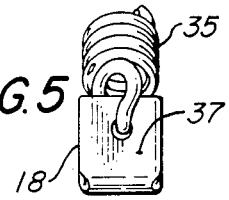

OVEN DOOR HINGE ASSEMBLY

FIELD OF THE INVENTION

This invention relates to a hinge mechanism and, more particularly, relates to hinge mechanisms for doors for major appliances.

BACKGROUND OF THE INVENTION

In doors for ovens, provision is usually made for a stop position of the door at a slightly open position for broiling. The doors are pivotally mounted adjacent their lower end to the body of the oven and, in many cases, utilize a counterbalancing compression spring which is included within the door. Such construction is exemplified in U.S. Pat. No. 3,749,080. The long counterbalancing compression springs used in this type of hinge are subject to fatigue failures, due to overstressing if not properly designed subject to possible binding, and additionally tend to be noisy in rubbing on the door covers.

Additionally, where the hinge is primarily contained in the door, the assembly is more difficult and time consuming.

The present invention provides a hinge for a door of the type described that requires no further assembly at the time of installation to the oven and attachment of the door thereto. A hinge embodying the invention has improved provision for being locked at a broiler stop position or in a fully open position. Additionally, the hinge is designed so that it may be mounted through the front of the oven without removing any exterior panels.

SUMMARY OF THE INVENTION

Briefly stated, the invention, in one form thereof, comprises an elongated guide member in the form of a channel, adapted to be mounted to a front panel surface, with an inclined ledge therein defining a stop on the side opposite of the incline, a hinge pivot providing member extends from the channel and provides a pivot for a door hanger lever, and a generally L-shaped hinge arm is pivotally connected to the door hanger lever above its pivot point at the lower leg thereof to the pivot providing member and carries a roller at the upper end thereof, which roller moves on the inside of the guide channel and over said inclined ledge, and may be retained behind the stop defined by the ledge. An expansion spring is connected between the upper end of the guide channel and also to an extending finger of the hinge arm. The spring biases the roller on the hinge arm to maintain contact of the roller with the channel.

The hinge is self-contained so that no further assembly of the hinge is required at the time of installation to the oven. The design of the hinge utilizing the expansion spring reduces noise, eliminates spring binding, and is less subject to fatigue failure than compression springs used in the same application. Moreover, the hinge construction counterbalances the door weight so that little effort is required to lift the door closed. The hinge is particularly adapted to be used on major household appliances such as ovens and dishwashers.

The invention provides a hinge assembly that is self contained and no assembly of the hinge is required at installation in the appliance. The use of an expansion spring redudes noise, eliminates spring binding, and can provide longer fatigue life than compression springs. The construction of the hinge counterbalances the door weight, so little effort is required to lift the door to a closed position. The hinge has a low profile in the opening of the door and provides a stop at the full open position blocking movement of the door beyond full open. The construction of the hinge facilitates installation or removal of the oven door. The spring is selected to provide counterbalancing torques and functional positions which will fit most ranges and other appliances; and the hinge is designed so that it may be mounted through the front of the oven without removing any exterior panels.

An object of this invention is to provide a new, improved and simplified hinge construction for an appliance door or the like.

Another object of this invention is to provide a new and improved hinge construction for an appliance door which is easy to install and to which the door may be easily mounted.

The features of the invention which are believed to be novel are particularly pointed out and distinctly claimed in the concluding portion of this specification. The invention, however, together with further objects and advantages thereof, may best be appreciated by reference to the following detailed description taken in conjunction with the drawings.

BRIEF DESCRIPTION OF THE DRAWINGS

FIG. 1 is a perspective view showing a combination range and oven appliance in which the oven door is shown in three different positions, and with hinge mechanisms mounted thereto;

FIG. 2 is a front elevation of a hinge assembly embodying the invention;

FIG. 3 is a partial side elevation of the mechanism of FIG. 2;

FIG. 4 is a view seen in the plane of lines 4–4 of FIG. 2;

FIG. 5 is a view seen in the plane of lines 5–5 of FIG. 2; and

DETAILED DESCRIPTION OF A PREFERRED EMBODIMENT OF THE INVENTION

Figure 8:
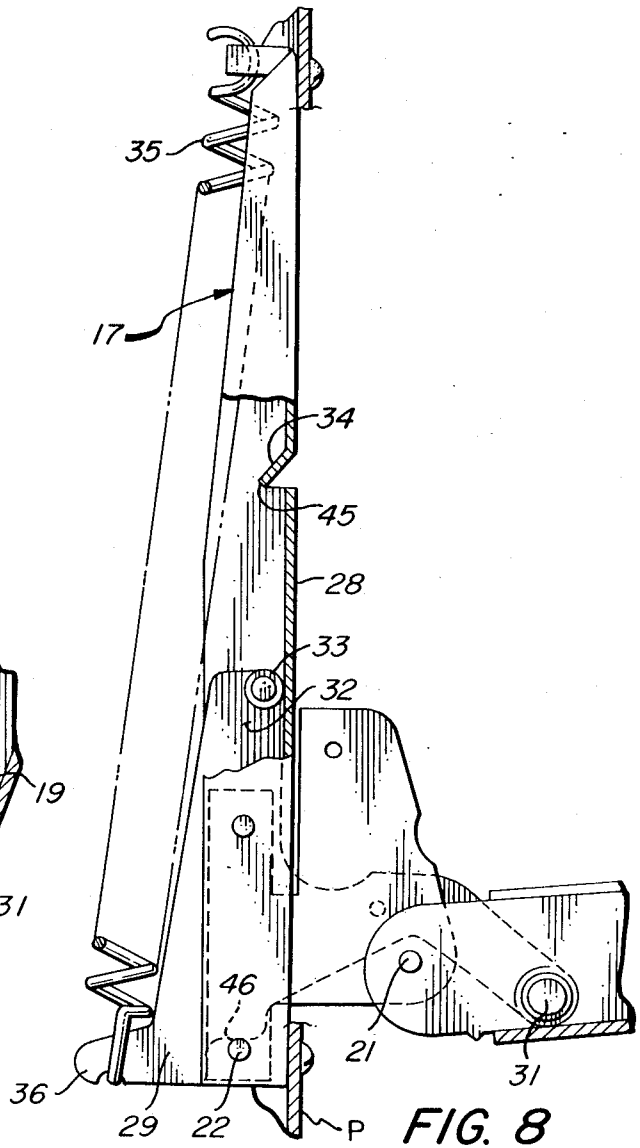
FIGS. 6, 7, and 8 are side fragmentary elevations of a hinge mechanism embodying the invention mounted to an oven and the door thereof.

FIG. 1 illustrates a combined range and oven appliance 11 which comprises a top surface 12 having the conventional four burners 13, a control panel 15, and an oven door 16 shown in the closed position, a broiler operating position at 16*a*, and a full open position at 16*b*. The door normally closes the oven cavity. The door 16 is mounted to the appliance by a pair of hinge mechanisms 17. The hinge mechanisms, as hereinafter more fully explained, have a portion which is secured to front edge panels of the appliance and a portion which mounts thereon the door 16.

Reference is made to FIGS. 2 and 3. A hinge mechanism 17 embodying the invention comprises an elongated guide member in the form of a channel like member 18, a door hanger lever 19, a hinge pivot member 20 fixedly secured to channel 18, to which the door hanger lever 19 is pivotally mounted about a pin 21. Hinge pivot member 20 is mounted to one leg of channel member 19 by a pin 22 which extends between legs 24 and 25 of channel member 18, and a rivet 26 extending through member 20 and leg 25. Pin 22 also provides a limit on the opening of door 16 as hereinafter described. An opening 27 is defined in the base 28 of channel member 20 and member 21 and one leg 29 of a generally L-shaped hinge arm 30 extends therethrough. Leg 29 is pivotally connected to door hanger lever 19 intermediate the ends thereof by a pin or rivet 31. Hinge arm 30 also includes an upwardly extending leg 32 carrying a roller 33. An incline and stop 34 is defined on base 29 of channel member 18 by upsetting a portion of the base 28. An expansion spring 35 is connected to an end 36 of member 29 and is connected at its other end as shown in FIG. 5 to a folded over portion 37 of channel member 18.

Figure 6:
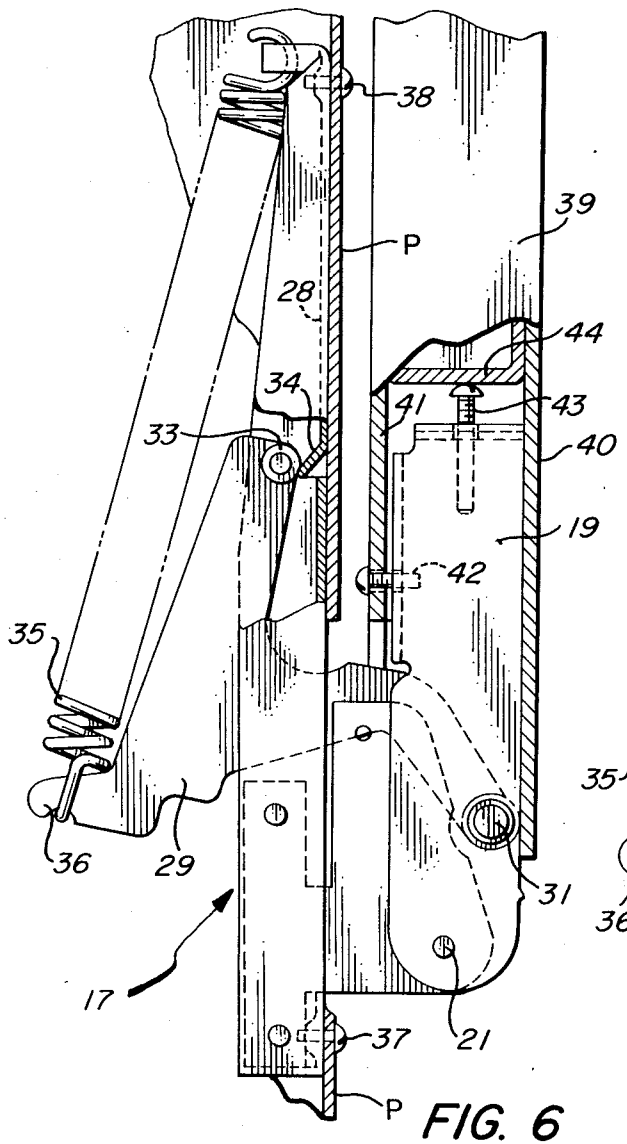

Reference is now made to FIG. 6 which shows the hinge mechanism 17 mounted to an oven and having an oven door mounted thereto. The oven has front edge panels P with an opening defined therein. Channel member 18 is mounted to the edge panels by means of screws 37 and 38, which extend through panels P and are threadably received in the base 28 of channel member 18. An oven door 39 has front and back panels 40 and 41 defining a recess which receives door hanger lever 19. Door 39 is mounted to the hanger levers of each of the hinge mechanisms by means of screws 42. An adjustment screw 43 is received in the top of hanger lever 19 in a bent over portion thereof.

Screw 43 is provided for mounting purposes. It may be adjusted to provide a stop for a reinforcing door member 44 and correctly position the door 39 on door mounting lever 19.

As shown in FIG. 6, spring 35 is slightly in tension, and acting on finger 36 of hinge arm 29. This tends to rotate lever 29 in a clockwise direction about roller 33 as viewed in FIG. 6. Leg 30 of lever 29 then holds door mounting lever 20 and the door 39 thereon in a closed position. Spring 35 also produces a moment on hinge arm 30 which maintains roller 33 in contact with base 28 of channel member 18.

Figure 7:
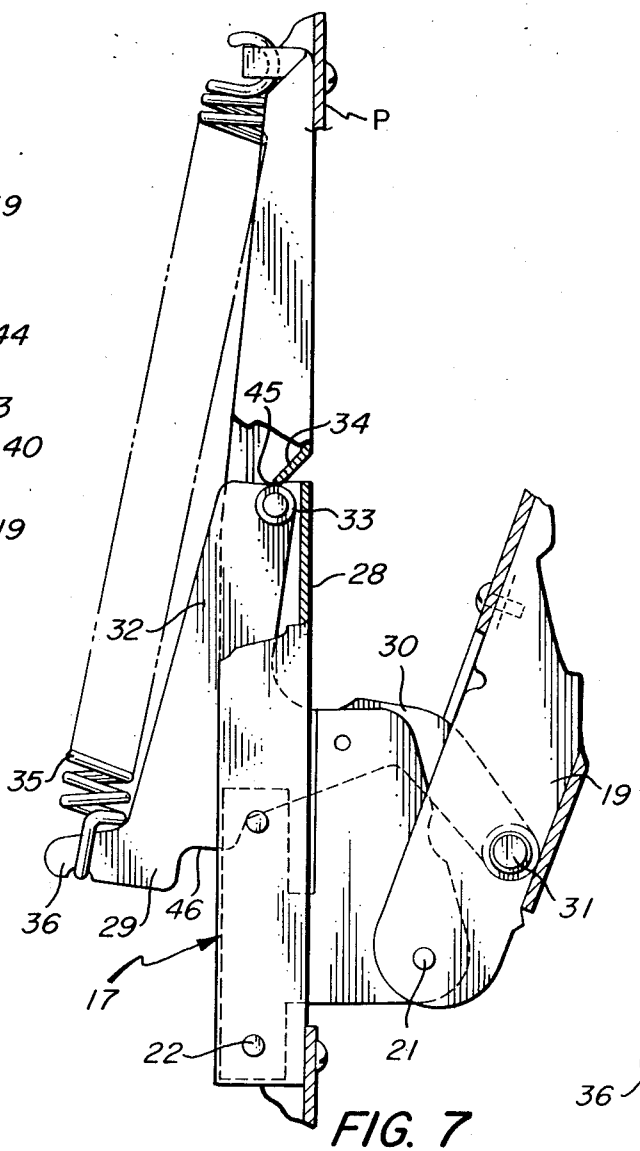

When door 16 is opened to the oven broil position, as shown in FIG. 7, door hanger lever 19 pivots clockwise about pin 22, and in so doing, pulls downwardly on arm 29 of lever 30 carrying rollers 33 over incline 34. The edge 45 of incline 33 acts as a stop for rollers 32. Spring 35 has been placed in more tension and tends to pull lever 29 upwardly over stop edge 45. However, this tension in spring 34 is counterbalanced by the weight of the door.

Reference is now made to FIG. 8 which exemplifies the door 18 in the full open position. As one opens the door 18 past the broiler stop, roller 33 moves on base 28 of channel 18 downwardly to the position shown, hinge arm 29 rotates as it moves downwardly. The full open position of the door is defined by edge 46 of hinge arm 30 engaging pin 22, which provides a door limiting stop.

The spring 35 is selected to counterbalance the weight of a door to be attached to hanger levers 19. Where the door opens downwardly as in the case of an oven, the spring is designed to allow the door to drop the last twenty degrees without hand pull.

While a hinge embodying the invention has been disclosed in conjunction with an oven, it may also be used on a dishwasher. In this later use, the stop would not be required to hold a door in a predetermined partially open position.

It may thus be seen that the objects of the invention set forth, as well as those made apparent from the foregoing description, are efficiently attained. While a preferred embodiment of the invention have been set forth for purpose of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A pre-assembled hinge for a door on an appliance where the door is arranged to close the opening to an appliance cavity and the appliance includes spaced apart front panel surfaces extending along opposite side margins of the door cavity and to which a pair of said hinges are attached, said hinge comprising an elongated vertical guide member having upper and lower ends and adapted to be fixedly secured to the front panel surface of the appliance, said guide member substantially defining the vertical length of the hinge, a hinge pivot member secured to said guide member adjacent the lower end of said guide member and extending outwardly from said guide member adjacent its lower end in a direction generally perpendicular to the longitudinal axis of said guide member and adapted to extend outwardly from and generally perpendicular to the front panel surface of the associated appliance, a door hanger lever pivotally connected adjacent its lower end to the outwardly extending portion of said pivot member, said hanger lever being adapted to support the associated door thereon upon mounting of the lower end of the door thereon, said lever being pivotable between a door closing position extending generally parallel to said guide member and a door opening position extending generally perpendicularly thereto, a generally L-shaped hinge arm having first and second legs, said first leg extending outwardly of said guide member and generally perpendicular to the longitudinal axis of said guide member, said hinge arm being connected adjacent its free end to said hanger lever at a point spaced upwardly from the pivotal connection of said hanger lever to said pivot member, said second leg being spaced upwardly from said first leg carrying roller means adjacent its free end, said roller means being disposed against a vertically extending surface of said guide means, a coil spring having one end connected to an upper portion of said guide member spaced above said second leg and its other end connected to said hinge arm intermediate its length, whereby said spring biases said roller means on said hinge arm against said guide member, said hinge arm being rollable on said roller downwardly along said vertically extending surface of said guide member against the biasing pressure of said spring to said door opening position position wherein said hinge arm abuts movement limiting means when said door hanger lever is substantially perpendicular to said guide member, and first stop means on said vertically extending surface of said guide member for limiting movement of said roller on said hinge arm intermediate the length of its path of movement on said guide member to hold said lever in a third position between said door opening and door closing positions and thereby function to hold the associated appliance door in a partially open position.

2. The hinge of claim 1 wherein said first stop means comprises an included ledge with a stop for said roller means therebehind, whereby said roller means may be rolled over said ledge and caught on said stop under the biasing pressure of said spring.

3. The hinge of claim 2 where said guide member is channel shaped, wherein said vertical surface on which said roller means rolls is the base of the channel, and wherein said ledge is formed by upsetting a portion of said channel.

4. The hinge of claim 1 wherein said guide member is in the form of a channel and said movement limiting means is a pin extending through the sidewalls of said channel, and an edge of said hinge arm.

5. A pre-assembled hinge for a door on an appliance where the door is arranged to close the opening to an appliance cavity and the appliance includes spaced apart front panel surfaces extending along opposite side margins of the door cavity and each adapted to mount one of said hinges, said hinge comprising an elongated guide member defining a vertical guide channel and having upper and lower ends, said guide member being adapted to be secured to the front panel surface of the appliance, said guide channel having an inclined ledge therein intermediate its length providing a stop on the side opposite that defining said incline, said guide member substantially defining the vertical length of the hinge, a hinge pivot member secured to said guide member adjacent the lower end of said guide member and extending outwardly from said guide member adjacent its lower end and adapted to extend outwardly from the front panel surface of the associated appliance, a door hanger lever pivotally connected adjacent its lower end to the outwardly extending portion of said pivot member, said hanger lever being adapted to support the associated door thereon upon mounting of the lower end of the door thereon, said lever being pivotable between a door closing position extending generally parallel to said guide member and a door opening position extending generally perpendicularly thereto, a generally L-shaped hinge arm having first and second legs, said first leg extending outwardly of said guide member and being connected to said first hanger lever at a point spaced from the pivotal connection of said hanger lever to said pivot member, said second leg carrying roller means adjacent its free end, said roller means being disposed against the vertical surface at the base of said guide channel a coil spring having one end connected to an upper portion of said guide member and its other end connected to said hinge arm intermediate its length, whereby said spring biases said roller means on said hinge arm against said guide member, said hinge arm being rollable on said roller along said surface of said guide member against the biasing pressure of said spring over said ledge to a position wherein said roller means is caught behind said stop and holds said door hanger lever and the associated door thereon in a partially open position, and said hinge arm being further rollable on said guide member against the biasing pressure of said spring to a position wherein said door hanger lever is substantially perpendicular to said guide member, and limit means on said guide member for limiting downward movement of said hinge arm on said guide member to limit the opening of the associated door to the horizontal position.

* * * * *